United States Patent [19]

Shibata et al.

[11] Patent Number: 4,823,140

[45] Date of Patent: Apr. 18, 1989

[54] ANTENNA DEVICE FOR A TELEVISION RECEIVER MOUNTED ON AN AUTOMOBILE

[75] Inventors: Shinya Shibata, Kawasaki; Takayasu Hokusho, Yokohama; Masakazu Tsunoda, Fujisawa; Yasushi Kawakami, Atsugi, all of Japan

[73] Assignees: Asahi Glass Company Ltd., Tokyo; Nissan Motor Company, Limited, Yokohama, both of Japan

[21] Appl. No.: 743,923

[22] Filed: Jun. 12, 1985

[30] Foreign Application Priority Data

Jun. 18, 1984 [JP] Japan ..... 59-123673
Mar. 7, 1985 [JP] Japan ..... 60-43625

[51] Int. Cl.[4] ..... H01Q 1/32
[52] U.S. Cl. ..... 343/713
[58] Field of Search ..... 343/713, 705, 708, 711, 343/712

[56] References Cited

U.S. PATENT DOCUMENTS

| | | | |
|---|---|---|---|
| 3,004,153 | 10/1961 | Alford | 343/705 |
| 4,003,057 | 1/1977 | Luedtke et al. | 343/713 |
| 4,394,779 | 7/1983 | Hansen | 343/713 |
| 4,602,260 | 7/1986 | Lindenmeier | 343/713 |

OTHER PUBLICATIONS

Translation of a portion of a report of the Japanese Television Society published on May 27, 1982.

*Primary Examiner*—William L. Sikes
*Assistant Examiner*—Robert E. Wise
*Attorney, Agent, or Firm*—Oblon, Fisher, Spivak, McClelland & Maier

[57] ABSTRACT

An antenna device for a television receiver mounted on an automobile comprises a front glass antenna including at least two antenna conductors which are separately provided in a windshield glass of the automobile; at least one second antenna provided on the automobile at a position spaced from the front glass antenna, and a switching circuit which is connected to the at least two antenna conductors of the front glass antenna and the at least one second antenna so as to selectively use signals received by the antenna.

5 Claims, 6 Drawing Sheets

ANTENNA DEVICE FOR A TELEVISION RECEIVER MOUNTED ON AN AUTOMOBILE

BACKGROUND OF THE INVENTION

1. Field of the Invention

The present invention relates to an antenna device which is most suitable for a television receiver mounted on an automobile.

2. Description of Prior Art

In an antenna device for a television receiver for an automobile, there are requirements of reduction of a phenomenon that a television image is disturbed during movement of the image by an influence of fading caused by a standing wave which takes place by interference between a direct radio wave from a transmission antenna and a radio wave reflected by buildings, mountains and the surface of land, a phenomenon of out of synchronization which gives difficulty in seeing a television image, a phenomenon of failing to receive a radio wave even when an automobile is stopped if an antenna is at a position corresponding the valley of a standing wave, a ghosting phenomenon causing double television images, and a TV fluttering phenomenon of movement of the ghost. Further, the antenna device should be small in size and light in weight and easily fitted to the automobile.

As an antenna device for a television receiver for an automobile to improve the above-mentioned points, there is known an antenna device as shown in FIG. 16 which is disclosed, for instance, in "Diversity receiving system for a color television receiver for an automobile" (a report of Television Society) published on May 27, 1982. The disclosed antenna device comprises two antennae 41, 42 each consisting of a plurality of elements, which are respectively attached to the left and right sides of the roof 44 of a car body 43, to perform diversity reception of signals by the two antennae 41, 42. However, the antenna device of this type is poor in appearance because two antennae 41, 42 consisting of a plurality of elements project upward from the car body 43 and is also dangerous. Further, it has such drawbacks of generation of sound caused by wind during a high speed cruising, being easily broken down by mischievous touch in parking, becoming an obstacle when the automobile is to be entered in a garage, and of being costly.

SUMMARY OF THE INVENTION

It is an object of the present invention to provide an antenna device for a television receiver mounted on an automobile which improves TV fluttering and ghosting phenomena; imparts excellent sensitivity and directivity and removes a part projecting from the automobile, in view of the drawbacks of the conventional antenna device.

The foregoing and the other objects of the present invention have been attained by providing an antenna device for a television receiver mounted on an automobile which comprises a front glass antenna including at least two antenna conductors which are separately provided in a windshield glass of the automobile; at least one second antenna provided on the automobile at a position except for the front glass antenna, and a switching circuit which is connected to the at least two antenna conductors of the front glass antenna and the at least one second antenna so as to selectively use signals received by the antennae.

DETAILED DESCRIPTION OF PREFERRED EMBODIMENT

The present invention will be described with reference to drawing.

Figure 1:
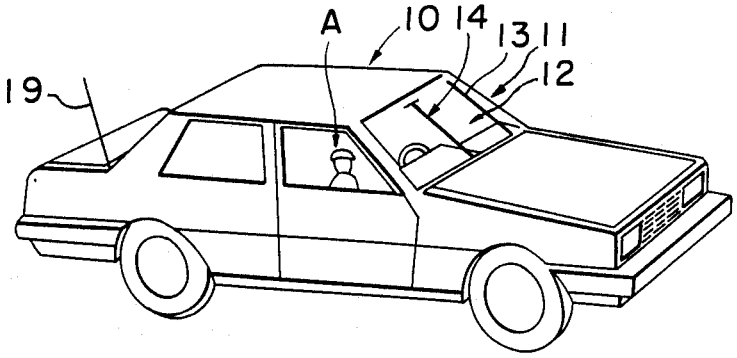
FIGS. 1 and 2 are respectively perspective views of automobiles in each of which an antenna device according to the present invention is installed.
Figure 2:
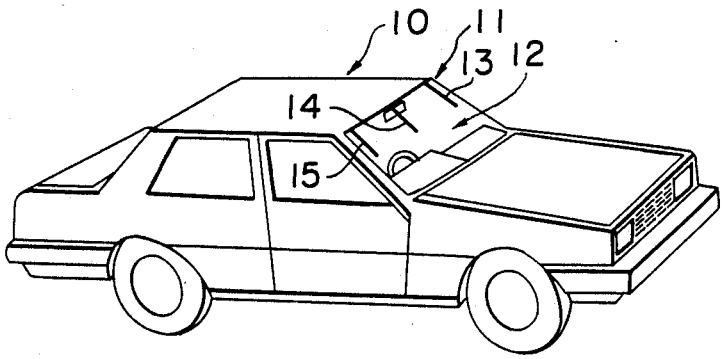
Figure 3:
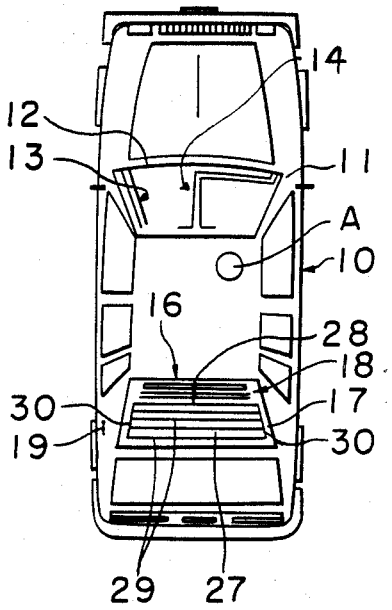
FIGS. 3 and 4 are respectively plan views of automobiles in each of which an antenna device according to the present invention is installed.
Figure 4:
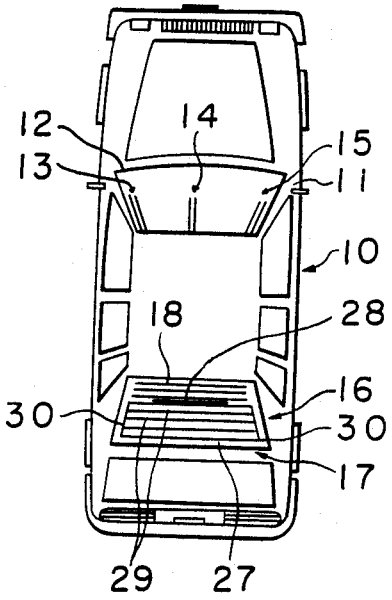
Figure 5:
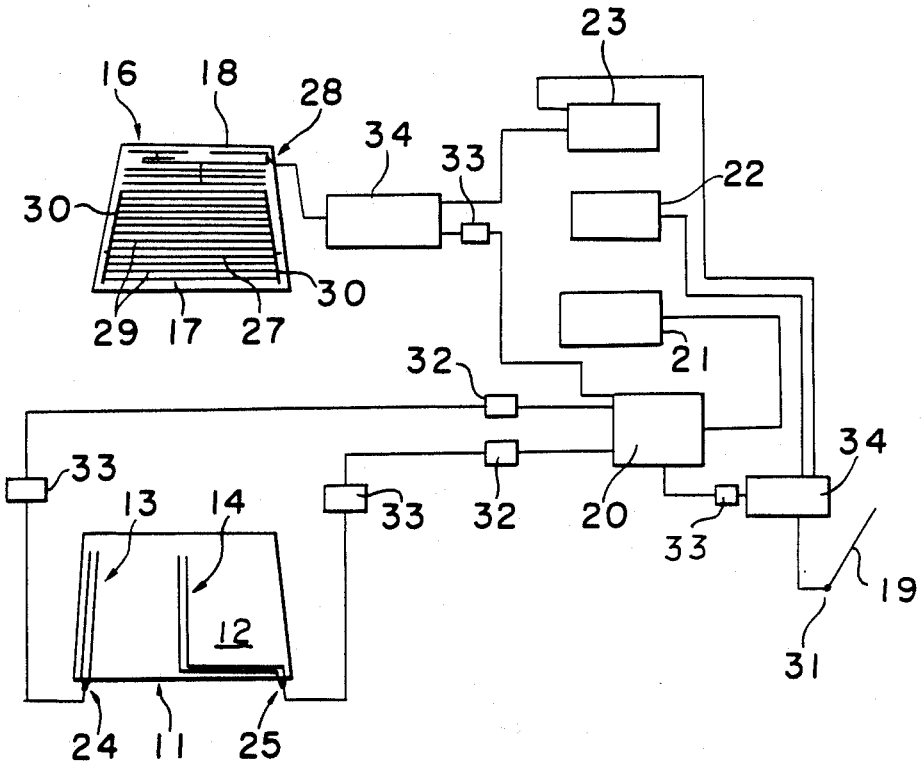
FIGS. 5 and 6 are respectively circuit diagrams showing the entire construction of embodiments of the antenna device according to the present invention.
Figure 6:
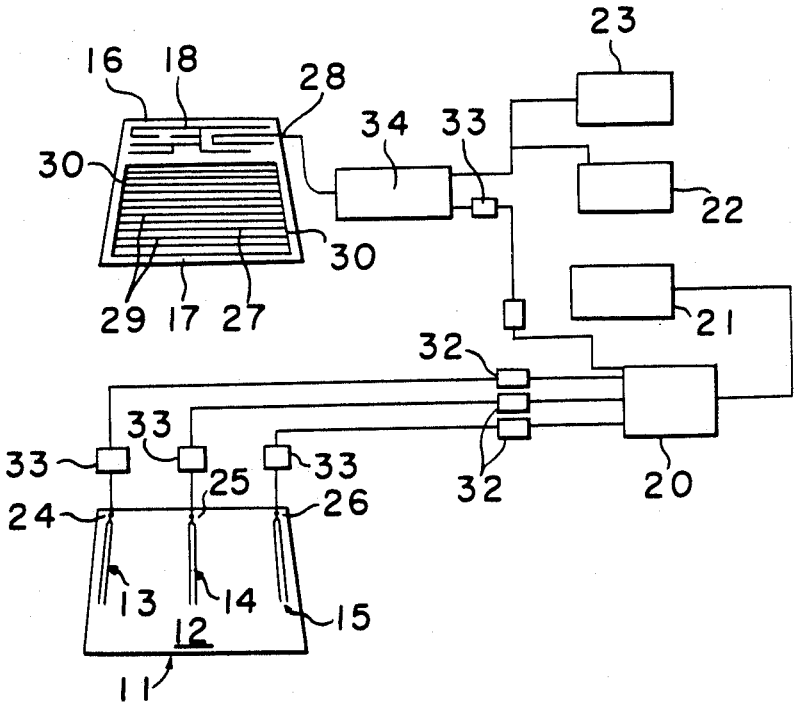
Figure 7:
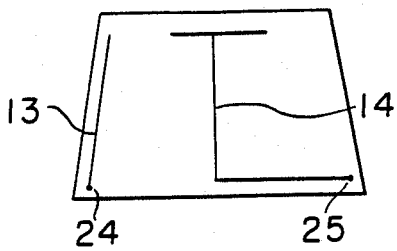
FIGS. 7 to 14 are respectively plan views showing several embodiments of front glass antennae of the antenna device of the present invention.
Figure 8:
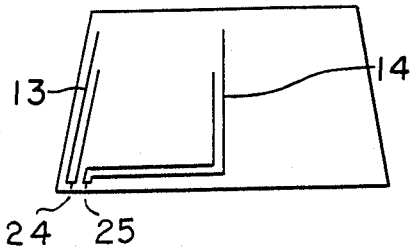
Figure 9:
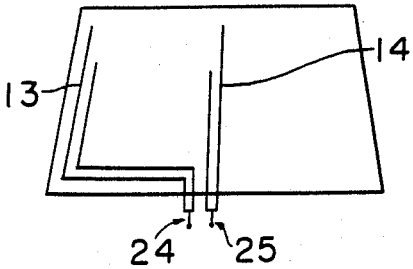
Figure 10:
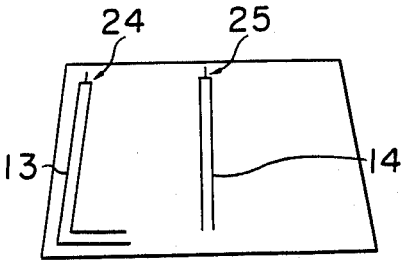
Figure 11:
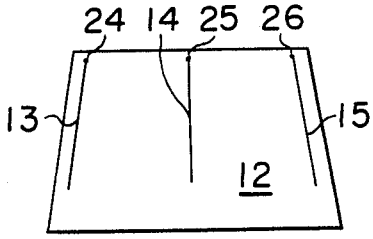
Figure 12:
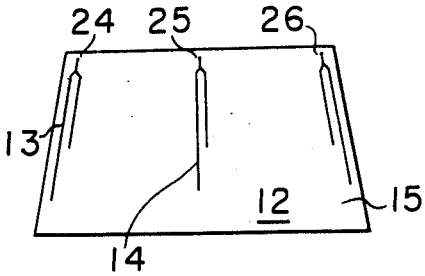

FIGS. 1 and 2 are perspective views schematically illustrating automobiles in which the antenna device of each embodiment of the present invention is installed; FIGS. 3 and 4 are respectively plan views of automobiles in each of which the antenna device of other embodiments of the present invention is assembled and FIGS. 5 and 6 are respectively circuit diagrams showing the entire construction of each of other embodiments of the present invention. In the Figures, a reference numeral 10 designates an automobile; a numeral 11 designates a front glass antenna including two antenna conductors 13, 14 or three antenna conductors 13, 14, 15 which are independently provided in a windshield glass 12 of the automobile 10; a numeral 16 designates a rear glass antenna, as one of the second antennae, comprising a rear window glass 17 including an antenna conductor 18; a numeral 19 designates a rear rod antenna, as the other one of the second antennae, which is attached to he rear part of the automobile 10 projecting upward; a numeral 20 designates a switching circuit for selectively receiving signals from each of the antenna conductors 13, 14, 15 of the front glass antenna 11, the rear glass antenna 16 and the rear rod antenna 19, or each of the antenna conductors 13, 14, 15, 18 of the front glass antenna 11 and the rear glass antenna 16; a numeral 21 designates a television receiver to be mounted on the automobile; a numeral 22 designates an AM radio receiver mounted on the automobile; and a numeral 23 designates an FM radio receiver mounted on the automobile.

As preferred embodiments of the front glass antenna according to the present invention in which two antenna conductors 13, 14 are independently provided in the windshield glass 12 of the automobile 10, the antenna conductor 14 is provided in the substantially central portion of the windshield glass 12 in the substantially vertical direction and the antenna conductor 13 is provided in the windshield glass 12 at the side of assistant driver's seat in the substantially vertical direction, while it is spaced apart the front window frame, namely, D.O.L (a daylight opening line) with a predetermined distance of, for instance, 30 mm to 100 mm as shown in FIGS. 1, 3, 5 and 7 to 10.

These antenna conductors 13, 14 may be so arranged that they extend from the lower side the windshield glass 12 toward the upper part of the windshield glass 12, or they extend from the upper side toward the lower part. However, when the antenna conductors are provided in the windshield glass, it is necessary to locate power feeding points, i.e. terminals for the antenna conductors at the lower side of the windshield glass owing to the regulation of JASO. Accordingly, it is preferable that the antenna conductors 13, 14 extend from the lower side of the windshield glass 12 toward the upper part of it, or if necessary, a curved portion or a branched portion is formed in the antenna conductors so that the power feeding points for the antenna conductors are located at the lower side. Alternatively, the power feeding points may be provided at the upper side of the windshield glass so that the antenna conductors extend from the upper side to the lower part. In this case, it is desirable that the antenna conductor 13 to be provided at a side portion of the windshield glass 12 is determined to be at the side of assistant driver's seat so as not to hinder the field of view of a driver A. For instance, in a right-handle automobile, the antenna conductor 13 is positioned at the left side of the windshield glass and in a left-handle automobile, it is positioned at the right side of the windshield glass.

FIGS. 2, 4, 6, 11 and 12 show other embodiments of the front glass antenna according to the present invention. Three antenna conductors 13, 14, 15 are independently provided in the windshield glass 12 of an automobile 10. The antenna conductor 14 among the conductors 13, 14, 15 is provided in the substantially central portion of the windshield glass 12 in the substantially vertical direction and the remaining antenna conductors 13, 15 are provided at left and right sides of the windshield glass 12 so that they are symmetrical with respect to the vertical center line of the windshield glass 12 in the substantially vertical direction of the same, while they are spaced apart from the windshield glass frame, i.e. D.O.L (daylight opening line) with a predetermined distance of, for instance, 30 mm to 100 mm.

Figure 13:
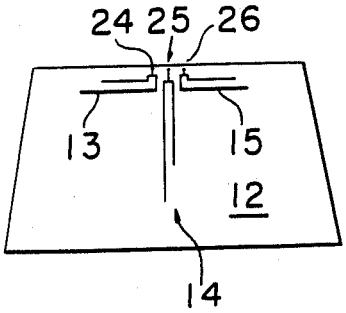
Figure 14:
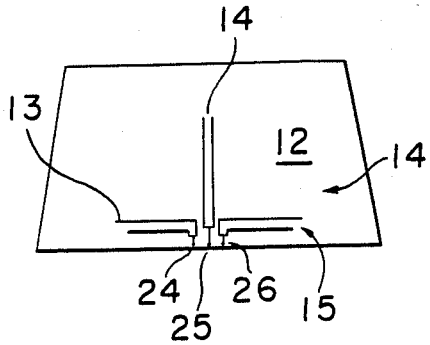

FIGS. 13 and 14 show the other embodiments of the front glass antenna. Three antenna conductors 13, 14, 15 are independently provided in the windshield glass 12 of an automobile 10. Among three antenna conductors, the antenna conductor 14 is provided at the substantially central portion of the windshield glass 12 in the substantially vertical direction; the second antenna conductor 13 extends from the vicinity of the central portion of the windshield glass 12, for instance it extends vertically from the vicinity of the left side of the antenna conductor 14 and it extends laterally toward the left side of the windshield glass from a point where the antenna conductor 13 extends vertically to some extend, whereby the second antenna conductor 13 gives a substantially L-shaped pattern and the third antenna conductor 15 extends from the vicinity of the central portion of the windshield glass 12, for instance, it extends vertically from the vicinity of the right side of the antenna conductor 14 and it extends laterally toward the right side of the windshield glass at a position where the antenna conductor 15 extends vertically to some extend, whereby the third antenna conductor 15 gives a substantially L-shaped pattern. Further, the antenna conductors 13, 15 are arranged so as to be symmetrical with respect to the vertical center line of the windshield glass 12 with a predetermined distance of, for instance, 30 mm to 100 mm to D.O.L.

Figure 15:
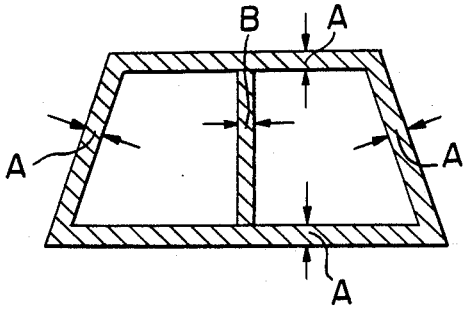
FIG. 15 is a diagram showing an area of windshield glass is provided.
Figure 16:
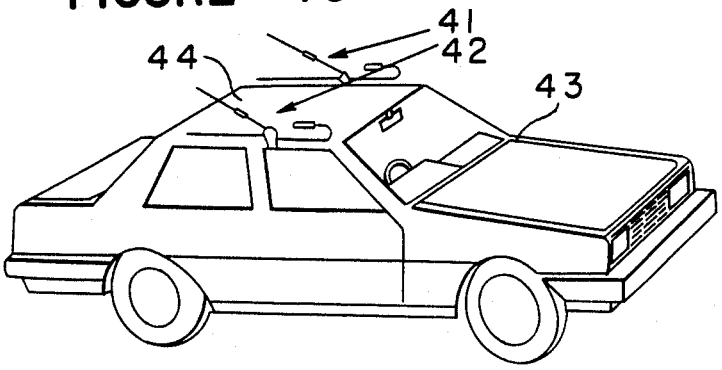
FIG. 16 is a perspective view of an automobile in which a conventional antenna device for a television receiver is installed.

The three antenna conductors 13, 14, 15 may be extended from the upper side of the windshield glass 12 toward the lower part, or may be extended from the lower side toward the upper part. In some case, one or two antenna conductors among three conductors 13, 14, 15 may be extended from the upper side toward the lower part and the remaining may be extended from the lower side toward the upper part unlike the embodiments shown in FIGS. 2 to 8. It is preferable that the antenna conductors 13, 14, 15 are arranged in the windshield glass 12 so as not to be obstacle to the field of view of a driver and a passenger at the assistant driver's seat. FIG. 15 shows a preferred range in arranging antenna conductors in the windshield glass so as not to hinder the forward field of view of a car driver. Namely, the antenna conductors (the thickness of each element of the antenna conductors is 0.25 mm or less and number of each element is within two) of the front glass antenna are preferably arranged in strip areas which are within 100 mm from the outer periphery of the opening of the windshield glass 12 (in an area of A=100 mm in FIG. 15) and having the width of 65 mm which is symmetrical to the vertical center line of the windshield glass 12 (in an area of B=65 mm in FIG. 15).

The antenna conductors 13, 14 are provided with power feeding points 24, 25, or the antenna conductors 13, 14, 15 are provided with power feeding points 24, 25, 26 respectively. The feeding points 24, 25 or the feeding points 24, 25, 26 may be provided at the upper side of the windshield glass 12, or may be at the lower side thereof. Alternatively, one or two among the feeding points 24, 25 or the feeding points 24, 25, 26 may be provided at the upper side and the remaining may be provided at the lower side. It is possible that the feeding points of the antenna conductor 13 and/or 14 of the windshield glass 12 are positioned at the side portion of the windshield glass 12, or the feeding points 24, 26 of the antenna conductors 13, 15 provided at the right side and/or the left side are respectively positioned at the side portion of the windshield glass 12. With regard to the feeding points 24, 25 or the feeding points 24, 25, 26, it is preferable to provide the feeding points at the lower side portion of the windshield glass 12 because there is a regulation of JASO (Japan Automotive Standard Organization). In this case, the feeding points 24, 25 or the feeding points 24, 25, 26 may be separately provided in the lower side portion, or may be gathered at a position. In case of change in the regulation of JASO or use in any country without having such regulation, it goes without saying that the feeding points can be provided at the upper side portion, or one of the feeding points can be provided at the upper side portion and the remaining can be provided at the lower side portion. Further, the feeding points 24, 25 of the antenna conductors 13, 14 or the feeding points 24, 26 of the antenna conductors 13, 15 provided at the right side and/or the left side in the windshield glass 12 can be positioned at a side portion or side portions of the windshield glass 12.

In the two antenna conductors 13, 14 or the three antenna conductors 13, 14, 15 provided in the windshield glass in the substantially vertical direction (when the windshield glass is fitted to the front window of an automobile, it is in an inclined state), the length and the number of the antenna conductors and a pattern of arrangement of the antenna conductors are selected so as to receive television broadcast waves of VHF and/or UHF with a desired performance. In such antenna conductors, it is desirable to design the antenna conductors so that a high gain is obtainable over the entire region of television frequency band; f characteristics (fluctuation of gain by frequency) is small, and good non-directivity can be obtained. However, it is generally difficult to satisfy such requirements. Accordingly, it is desirable for the front glass antenna to have characteristic such as compensation of the function of at least one of the second antennae, e.g. a rear glass antenna or a rear whip (or rod) antenna, which is provided in an automobile at a position other than the front glass antenna, by imparting a high gain at a part where directivity characteristic or frequency characteristic of the at least one of the second antennae decreases. The antenna conductors 13, 14 or the antenna conductors 13, 14, 15 may be respectively composed of a single element as shown in FIGS. 1, 2, 7 and 13, or may be composed of two elements as shown in FIGS. 3 to 6, 8 to 10 and 12 to 14. In some cases, they may be composed by three or more elements. Further, each of the antenna conductors 13, 14 or the antenna conductors 13, 14, 15 may have different number of elements. An auxiliary element may be provided in parallel to the primary element with a predetermined space, or a branched line may be provided in the primary element, or the primary element may be bent. In the case of the antenna conductor made of a single element as shown in FIGS. 1, 2, 7 and 13, there is a tendency that it is difficult to attain a high gain over a broad television frequency band. On the other hand, there is a tendency to broaden a television broadcast frequency band to obtain a high gain when two or more antenna conductor elements are used as in FIGS. 3 to 6, 8 to 10 and 12 to 14. Accordingly, it is desirable to use two or more elements for the antenna conductors. Alternatively, the antenna conductors are constituted by two antenna lines of a longer lines and a shorter lines, the longer line used for a VHF antenna and the shorter line for a UHF antenna. In some cases, the antenna conductors may be composed of three antenna lines: the longer one used for a radio antenna, the middle one for a VHF antenna and the shorter one for a UHF antenna. The length of the antenna conductor varies depending on specification for the antenna, the shape of a window glass, the shape of a car body and the other condition. Generally speaking, it is desirable the length is within a range of $(\lambda/4)\alpha \pm (\lambda/20)\alpha$ ($\alpha$: reduction factor of a wavelength for a windshield glass antenna) of the wavelength of a desired middle frequency of the television broadcast frequency band. For instance, it is preferable in practice that the length is in a range of 270 mm to 360 mm in the case of combined use of VHF/UHF; a range of 400 mm to 500 mm for receiving VHF and a range of 190 mm to 250 mm for receiving UHF.

In the front glass antenna according to the present invention, the antenna conductor 14 at the central portion of the windshield glass extends in the substantially vertical direction or in the substantially vertical and horizontal directions in the windshield glass, and the antenna conductor 13 or the antenna conductors 13, 15 at the side portions of the windshield glass extend in the substantially vertical direction and/or in the lateral direction in the windshield glass. The front glass antenna has good signal receiving performance for both H/V components for a depolarized wave of transmittance. Further, the front glass antenna comprises two or three antenna conductors independently provided in the substantially vertical direction and/or in the substantially lateral direction in which one of the antenna conductor 14 among the two antenna conductors 13, 14 or the three antenna conductors 13, 14, 15 is arranged at the substantially central portion of the windshield glass 12, and the other antenna conductor 13 or the other antenna conductors 13, 15 are arranged at the side portions, the upper side portion or the lower side portion of the windshield. Accordingly, in an ordinary automobile, the distance between the antenna conductor 14 at the central portion and the antenna conductor 13 or the antenna conductors 13, 15 at the side portions is in a range of about 20 cm to 80 cm; the direction of the antenna conductor 14 is different from that of the antenna conductor 13 or the antenna conductors 13, 15 and the positions for arrangement of the antenna conductors are different from each other, whereby directivity for each of the antenna conductors is different. Accordingly, it is avoidable that the two antenna conductors 13, 14 or the three antenna conductors 13, 14, 15 are simultaneously in low potential points (dip points) in an electric field to be a low gain, on account of which the antenna conductors 13, 14 and the antenna conductors 13, 14, 15 sufficiently function as an glass antenna for a space diversity signal receiving system. Since the wavelength of the middle frequency of the VHF television broadcast frequency band in Japan is about 1.5 m, it is considered that when each of the antenna conductors is separated from each other in about one tens of the wavelength, e.g. about 15 cm, each of the conductors does not fall in the dip points in the electric field.

The second antenna of the present invention may be a rear glass antenna provided in the rear window glass of an automobile, a rod antenna (including a whip type antenna), provided on the car body of a automobile, one of trunk-lid antennae, or a combination of the antennae. It is especially preferable to use a front glass antenna and the second antenna, e.g. a rear glass antenna, a rear rod antenna (including a rear whip antenna), a trunk-lid antenna or a roof rod antenna which is provided in the automobile at a different position.

With respect to the directivity of the front glass antenna, the probability that the directivities of the second antenna such as the rear glass antenna and/or the rear whip (rod) antenna coincide with each other in various polarized wave component is extremely low because of the difference in the positioning of the feeding points and the difference in the antenna pattern and the influence of reflected waves on the conductors around the window. Accordingly, the front glass antenna having the directivity different from those of the second antenna such as the rear glass antenna and/or the rear whip (rod) antenna can readily be prepared.

In the present invention, the antenna pattern of the antenna conductor 18 in the rear glass antenna 16 provided in the rear window glass 17 as a sort of the second antenna is selected depending upon the shape of the automobile, the sizes and shape of the glass plate, etc., so as to obtain the optimum gain and non-directivity or a desired directivity, and particularly, the pattern is selected so as to obtain non-directivity or a desired directivity and a sufficient gain when television broadcast wave and/or radio waves of a FM and/or AM radio broadcast frequency bands are received. The rear glass antenna 16 is disposed on the rear window glass 17, i.e. an upper part of the glass plate fitted on the window frame of the automobile, preferably in a form of a combination of an element in a strip form. The antenna conductor 18 constituting the rear glass antenna 16 may be designed to have a pattern to obtain high gains for both of VHF and UHF television broadcast waves and to have the function for both of VHF and UHF television broadcast wave bands. It is also possible to design them to have a pattern having a part for mainly receiving a VHF television broadcast wave and a part for mainly receiving a UHF television broadcast wave, whereby both of the VHF and UHF television broadcast waves can be received. It is further possible to design the antenna conductor to have a pattern for receiving both of the VHF and UHF television broadcast waves and a part for mainly receiving the VHF broadcast wave, whereby both of the VHF and UHF broadcast waves can be received. Further, the antenna conductor may be designed to have a pattern so as to receive FM and/or AM radio broadcast frequency bands as well as television broadcast wave bands. Alternatively, it is possible to add a pattern for receiving FM and/or AM broadcast frequency bands.

The pattern of the antenna conductor 18 of the rear glass antenna 16 may be the one as shown in FIGS. 3 and 4 wherein the antenna is composed of a combination of a plurality of strip elements disposed symmetrically above a defogging electric heater 27 on the rear window glass 17 of the automobile, or it may be the one as shown in FIGS. 5 and 6 wherein the antenna conductor 18 is composed of a plurality of elements combined to present an asymmetric pattern relative to the vertical center line of the automobile.

A power feeding point 28 of the antenna conductor 18 is located at a desired part in the upper side portion or the lateral side portions of the rear window glass 17 depending on the necessity of design.

In the present invention, the defogging electric heater 27 may be provided in the lower part of the rear window glass 17 which is provided with the antenna conductor 18 at the upper part. For instance, a typical defogging electric heater is illustrated in FIGS. 3 to 6 in which the heater comprises a number of heating strips 29 having a width of from 0.5 mm to 2 mm and arranged in a transverse direction of the rear window glass substantially in parallel with one another with a space of from 2 cm to 4 cm, and bus bars 30 connected to the heater strips 29 to feed power to the same. However, the defogging electric heater is not limited to this specific example.

The relative positioning of the defogging electric heater 27 provided in the rear window glass 16 and the antenna conductor 18 may be such that they are spaced from each other with a sufficient distance of e.g. at least 2 cm so that the defogging electric heater 27 does not affect the antenna conductor 18 in either a direct current fashion or a high frequency fashion, or in order to positively utilize the defogging electric heater 27 for improvement of the desired directivity and gain for television broadcast wave or for improvement of the gain for radio broadcast wave, the antenna conductor 18 is disposed close to the defogging electric heater 27, e.g. with a distance of from 0.1 cm to 1.0 cm so that they are connected to each other in terms of the high frequency. FIGS. 5 and 6 show the rear glass antenna 16 of the former type in which the antenna conductor 18 is spaced from the defogging electric heater 27 with a distance of from 2 cm to 5 cm, and FIG. 4 shows the rear glass antenna 16 of the latter type.

It is possible to design the defogging electric heater 27 in such a manner that it is utilized as a part of the antenna conductor 18 to improve gain of the television broadcast waves and/or the radio broadcast waves, or to obtain desired directivity for the television broadcast waves and/or the FM broadcast wave. FIG. 3 shows the rear glass antenna 16 in which the defogging electric heater 27 is connected to the antenna conductor 18 provided above the heater 27 in a direct current fashion to improve the gain and directivity for the television broadcast waves and/or the radio broadcast waves.

Description has been made as to the rear glass antenna in which a single antenna conductor is provided in the rear window glass. However, it may be so designed that two power feeding points are formed for the single antenna conductor to perform the function of two antennae, or two or more antenna conductors are provided in the rear window glass in addition to a selecting antenna for space diversity signal reception.

Each of the antenna conductors constituting the front glass antenna and the rear glass antenna according to the present invention is formed in a printed line or a conductive slender metal wire by printing on the glass surface a conductive paste prepared by mixing and suspending a conductive metal powder (e.g. silver powder), low melting glass frits, a vehicle and other optional components to form a predetermined pattern and baking the printed paste, and, if necessary, further subjecting it to plating treatment. When the conductive slender metal wire is used, wiring of the slender metal wire is made on an intermediate film, which is then sandwiched between a pair of glass sheets to obtain a laminated glass. Particularly, in the case of the front glass antenna, the slender metal wire having the width of 0.25 mm or less is arranged on the intermediate film to form an antenna conductor and the intermediate film is sandwiched between two glass sheets to form a laminated glass type front glass antenna.

In the present invention, the rear rod antenna as the second antenna provided at the rear side of the car body of the automobile may be a rod type, a whip type or another type of rod antenna. The rear rod antenna 19 is attached to a desired position, e.g. either the left side or the right side in the rear of the automobile 10 or in the intermediate portion such as a side portion of the rear window glass.

The rear rod antenna is so designed that the entire length of the antenna is changed depending on a frequency selected. For instance, the length of the rear rod antenna is telescoped by means of a motor to have the optimum length in harmony with a selected frequency. More specifically, the rear rod antenna is preferably adjusted to have a length of about 74 cm in a case of 95 MHz (a lower frequency band in the VHF band), a length of about 37 cm in a case 198 MHz (a higher frequency band in the VHF band) and a length of about 12 cm in a case of 600 MHz (the intermediate frequency band in the UHF band).

In the present invention, a switching circuit 20 is provided in connection wires between the antennae and a television receiver 21 to be mounted on an automobile, or at a desired location in the television receiver 21 to selectively receive a signal of higher gain or of small noise, or of small distortion among signals received in the two antenna conductors 13, 14 or the three antenna conductors 13, 14, 15 of the front glass antenna 11, and signals received in at least one of the second antennae.

FIG. 5 shows an embodiment of the antenna device of the present invention in which a switching circuit 20 which selectively receives a signal of higher gain or of small noise, or of small distortion among signals received in the antenna conductors 13, 14 of the front glass antenna 11, signal received in the antenna conductor 18 of the rear glass antenna 15 and signal received in the rear rod antenna 19, is provided between the connection wires which connect the feeding points 24, 25, 26, 28 of each of the antennae 11, 16, 19 and the television receiver 21 mounted on the automobile.

FIG. 6 shows another embodiment of the antenna device of the present invention in which a switching circuit 20 which selectively receives a signal of higher gain or of small noise or of small distortion among signals received from the three antenna conductors 13, 14, 15 of the front glass antenna 11 and a signal received from the antenna conductor 18 of the rear glass antenna 16, is provided between connection wires which connect power feeding points 24, 25, 26, 28 of each of the antennae 11, 16 and the television receiver 21 mounted on the automobile. It is also possible to combine the rear rod antenna 19 as a selective antenna in the antenna device shown in FIG. 6.

The present invention utilizes a space diversity antenna system in which in order to improve non-diversity characteristic and gain, and reduce noise at the time of receiving television broadcast waves, a plurality of antennae are provided to selectively receive a signal of higher gain among signals of television broadcasting depending on the condition of radio waves which changes every moment. Accordingly, the switching circuit 20 may be constructed in such a manner that the gains of the signals of the television broadcast wave bands received in the plurality of antennae 11, 16 or 11, 16, 19 are compared and a signal having greater gain is selected to send it to the television receiver 21. With respect to the FM radio broadcast wave, the switching circuit 20 may be designed to selectively receive a greater FM radio signal to send it to the FM radio receiver 23.

When the television antenna of the present invention is utilized as a space diversity reception antenna for receiving an FM radio broadcast wave, all of four or five signals, i.e. signals from two or three antenna conductors of the front glass antenna, a signal from an antenna conductor of the second antenna such as the rear glass antenna and a signal from the rear whip antenna may be utilized as selected signals, or two or three or four signals may be utilized as selected signals. It goes without saying that at least one among three or four antenna conductors of the front glass antenna and the second antenna such as the rear glass antenna and the rear whip antenna may be utilized as antennae for receiving the FM radio wave and/or the AM radio wave.

When the antenna device has the function of receiving the radio broadcast waves as well as the television broadcast waves, the antenna device may be designed in such a manner that when a television/radio changing-over switch (not shown) is operated to be a position for receiving a television broadcast wave, the switching circuit 20 is connected to the television receiver 21 mounted on the automobile so that a signal having higher gain or of small distortion or of a small noise is selected from four or five signals from three or four antenna conductors of the front glass antenna and the rear glass antenna and the rear whip antenna, or when the television/radio changing-over switch is switched to a position for receiving the FM radio broadcast wave, the switching circuit 20 is connected to the FM radio receiver 23 so that a signal of higher gain or of small multi-pass distortion or of small noise is selected from two or more signals among the above-mentioned four or five signals, or when the switch is switched to a position for receiving the AM radio broadcast wave, at least one signal among the above-mentioned four or five signals is connected to the AM radio receiver 22 directly or through the switching circuit 20.

In the antenna device of the present invention, in order to enhance sensitivity of receiving the television broadcast wave, and if necessary, in order to enhance sensitivity for receiving the AM broadcast wave and/or the FM broadcast wave, a high frequency amplification circuit 32 is connected to at least one of the antennae constituting the antenna device, e.g. the antenna conductors 13, 14 or the antenna conductors 13, 14, 15 of the front glass antenna 11, the antenna conductor 18 of the rear glass antenna 16 and the rear rod antenna 19 as the second antenna. The high frequency amplification circuit 32 may be provided between the power feeding points of the antennae and the switching circuit, or may be provided between the switching circuit and an input terminal for antenna of the television receiver. The high frequency amplification circuit may be of a harmony type or of non-harmony type. If necessary, a matching circuit 33 may be inserted in at least one of the connecting lines which connect the switching circuit and the feeding points for the antenna conductors 13, 14 or the antenna conductors 13, 14, 15 of the front glass antenna 11, the antenna conductor 18 of the second antenna such as the rear glass antenna 16 and/or the rear rod antenna 19 to reduce mis-matching loss. When the matching circuit 33 is provided in the high frequency amplification circuit 32, it is preferable to provide it at the front stage (at the side of the power feeding points) of the high frequency amplification circuit 32.

A distributor may be inserted in the antenna device of the present invention when the antenna device is designed to receive at least two broadcast waves of the VHF television broadcast wave, the UHF television broadcast wave, the AM radio broadcast wave and the FM radio broadcast wave. FIG. 5 shows an embodiment of the antenna device in which a distributor 34 is connected to the rear glass antenna 16 and the rear rod antenna 19.

In accordance with the antenna device of the present invention, high gain and excellent non-directivity can be obtained in a broad region in the television broadcast wave bands; it can cope with variations in signal receiving condition, e.g. a fading phenomenon or a fluttering phenomenon during running of the automobile and it has remarkable feature as an antenna for a television receiver to be mounted on the automobile.

In accordance with an antenna device for a television mounted on the automobile, a projecting part can be eliminated from the car body of the automobile, hence air resistance is small; it is excellent in design ; there is no risk of breaking of the antenna, hence it is safe and it is free from rust whereby reduction in its performance is small.

What is claimed is:

1. An antenna device for a television receiver mounted on an automobile having a front windshield, a rear windshield, and a body, said antenna device comprising:

(a) a first antenna comprising:

(i) a first antenna conductor extending in the central portion of said front windshield in an at least substantially vertical direction and (ii) a second antenna conductor extending in a side portion of said front windshield in an at least substantially vertical direction;

(b) a second antenna spaced from said first antenna; and (c) a switching circuit means connected to said first and second antennas for receiving a signal from a selected one of said first and second antennas.

2. The antenna device according to claim 1, wherein said second antenna comprises at least one of a rear glass antenna provided in the rear windshield of the automobile, a rod antenna provided in the body of the automobile, and a trunk-lid antenna.

3. The antenna device according to claim 1, wherein:

(a) said first antenna includes a third antenna conductor extending in a side portion of said front windshield in an at least substantially vertical direction and (b) said second and third antenna conductors are provided at the left and right side portions in said front windshield in a symmetrical manner with respect to said first antenna conductor.

4. The antenna device according to claim 1, wherein said first and second antenna conductors respectively comprise two antenna elements having different lengths.

5. The antenna device according to claim 1, wherein said switching circuit is provided with at least one of a matching circuit and a high frequency amplification circuit, said matching circuit and said amplification circuit being connected to said first antenna and to said second antenna.

* * * * *